US005878504A

United States Patent [19]

Harms

[11] Patent Number: 5,878,504

[45] Date of Patent: Mar. 9, 1999

[54] RIFLE SCOPE VERTICAL ALIGNMENT APPARATUS AND METHOD

[76] Inventor: Jeffrey W. Harms, 1123 E. 1264 Rd., Lawrence, Kans. 66047

[21] Appl. No.: 926,043

[22] Filed: Sep. 9, 1997

[51] Int. Cl.[6] ..... F41G 1/38

[52] U.S. Cl. ..... 33/247; 33/245; 33/248; 33/286; 33/292

[58] Field of Search ..... 33/245, 247, 248, 33/286, 292

[56] References Cited

U.S. PATENT DOCUMENTS

| | | | |
|---|---|---|---|
| 3,908,282 | 9/1975 | Steffan | 33/234 |
| 4,095,347 | 6/1978 | Steffan | 33/234 |
| 5,442,860 | 8/1995 | Palmer | 33/233 |

*Primary Examiner*—Charles T. Jordan
*Assistant Examiner*—Chris J Brown
*Attorney, Agent, or Firm*—Litman, McMahon & Brown, L.L.C.

[57] ABSTRACT

A rifle scope vertical alignment apparatus includes first and second plates, each with a bottom surface shaped as an inverted V. A vertically oriented elongate slot is formed in one of the first and second plates and a receiving channel is formed in one of the first and second plates to slidably engage the other of the first and second plates. A level is positioned on one of the first and second plates such that it is visible from a rear surface of the apparatus. A threaded screw extends through the slot and into a threaded bore on the other of the first and second plates so that the plates can be held in a selected position relative to each other with the inverted V bottom surfaces aligned. The alignment method involves positioning the inverted bottom V of the first plate of the alignment apparatus atop the rifle barrel just in front of the objective end of the scope, placing the inverted V bottom surface of the second plate atop the scope barrel and then tightening the threaded screw. The rifle, scope and alignment apparatus are then leveled and a user sights through the scope at an external vertical reference line and rotatably adjusts the scope until the vertical reticle is precisely aligned with the external vertical reference line and then tightens the scope in position.

17 Claims, 2 Drawing Sheets

61
3.
31
25
11
15
41
5
34
42
16
4
12
24
32
3.
54
1
2
4

31
33
46
56
55
34
44
53
35
54
52
13
14

RIFLE SCOPE VERTICAL ALIGNMENT APPARATUS AND METHOD

FIELD OF THE INVENTION

The present invention relates to a rifle scope vertical alignment apparatus and method, and, more particularly, to such an alignment apparatus and method in which a vertical reticle of a rifle sighting scope can be quickly and accurately aligned vertically and horizontally with respect to a rifle barrel bore by reference to an external vertical reference line.

BACKGROUND OF THE INVENTION

Vertical alignment of a rifle scope with the bore of a rifle it is mounted on is often somewhat of a hit or miss exercise. Rifle sighting scopes are typically mounted atop a rifle barrel via clamping rings which are tightened via screws provided on either side of each clamping ring. Preferably, the clamping rings are aligned on the rifle barrel such that, when the scope is attached, the crosshair formed by the intersection of the horizontal and vertical scope reticles is reasonably well aligned with the barrel bore. Thus, the scope, once adjusted for windage and elevation, is accurate in the center of the reticle. However, the scope is not necessarily aligned vertically with the rifle barrel bore.

A problem arises during long distance shooting where a shooter must adjust the angle of his shot to account for the drop of the bullet during its trajectory to the target. In order to compensate for this drop, the shooter will typically move the rifle upward, i.e. move the target image vertically downward along the vertical reticle within the scope. However, if the scope is aligned with the rifle bore only at the center or crosshair of the horizontal and vertical scope reticles, i.e. the scope is misaligned vertically, which is often the case, as the target image is moved away from the crosshair along the vertical reticle, a horizontal error will be introduced.

It is clear, then, that a need exists for a simple and reliable apparatus and method for vertically aligning a rifle scope with the bore of a rifle upon which the scope is mounted.

SUMMARY OF THE INVENTION

The present invention is drawn to a rifle scope vertical alignment apparatus and method. The alignment apparatus includes a first plate with a bottom surface shaped as an inverted V and a vertically oriented elongate central slot. A second plate also has a bottom surface shaped as an inverted V and includes a channel sized to accommodate the width of the first plate. The second plate is slidably attached to the first plate via a threaded screw extending through the slot in the first plate and into a threaded bore in the second plate. The second plate has a horizontally oriented slot in its top surface which accommodates a bubble level which is thus visible from the rear of the apparatus.

In order to use the inventive alignment apparatus to vertically align a scope reticle with a rifle bore, the scope is first attached to the rifle. An external vertical alignment reference line is then located, preferably a plumb bob. The rifle is then placed on a pillow or other stable rest while being aimed at the external vertical reference line. The scope mounting screws are loosened just enough to allow the scope to be rotated within its mounting rings with minimal effort. An optional rubber band is placed around the objective end of the scope and the screw on the alignment apparatus is loosened. The inverted bottom V of the first plate of the alignment apparatus is placed atop the rifle barrel just in front of the objective end of the scope. The second plate of the alignment apparatus is then slidably adjusted upward or downward vertically until the bottom inverted V can be placed atop the scope barrel. Each of the inverted V's must contact the respective scope or rifle barrel in two places. The threaded screw is then tightened and the rubber band can be placed around the scope barrel and over the screw end to retain the apparatus in position. The rifle, scope and alignment apparatus are then leveled by centering the bubble within the marks on the bubble level. The user then sights through the scope at the vertical reference line and rotatably adjusts the scope until the vertical reticle is precisely aligned with the external vertical reference line. The scope mounting screws are then retightened gradually and evenly while periodically rechecking the alignment and the alignment apparatus is then removed.

OBJECTS AND ADVANTAGES OF THE INVENTION

The objects and advantages of the present invention include: providing a rifle scope vertical alignment apparatus and method; providing such an apparatus and method which allows a rifle scope to be quickly, conveniently and accurately vertically aligned with the bore of the rifle; providing such an apparatus and method in which an external vertical reference line is used to align the vertical reticle of the scope; providing such an apparatus and method which includes a level for leveling scope and rifle during the alignment procedure; providing such an apparatus and method which is highly accurate; and providing such an apparatus and method which is relatively simple, economical to manufacture, yet is durable and particularly well suited to its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
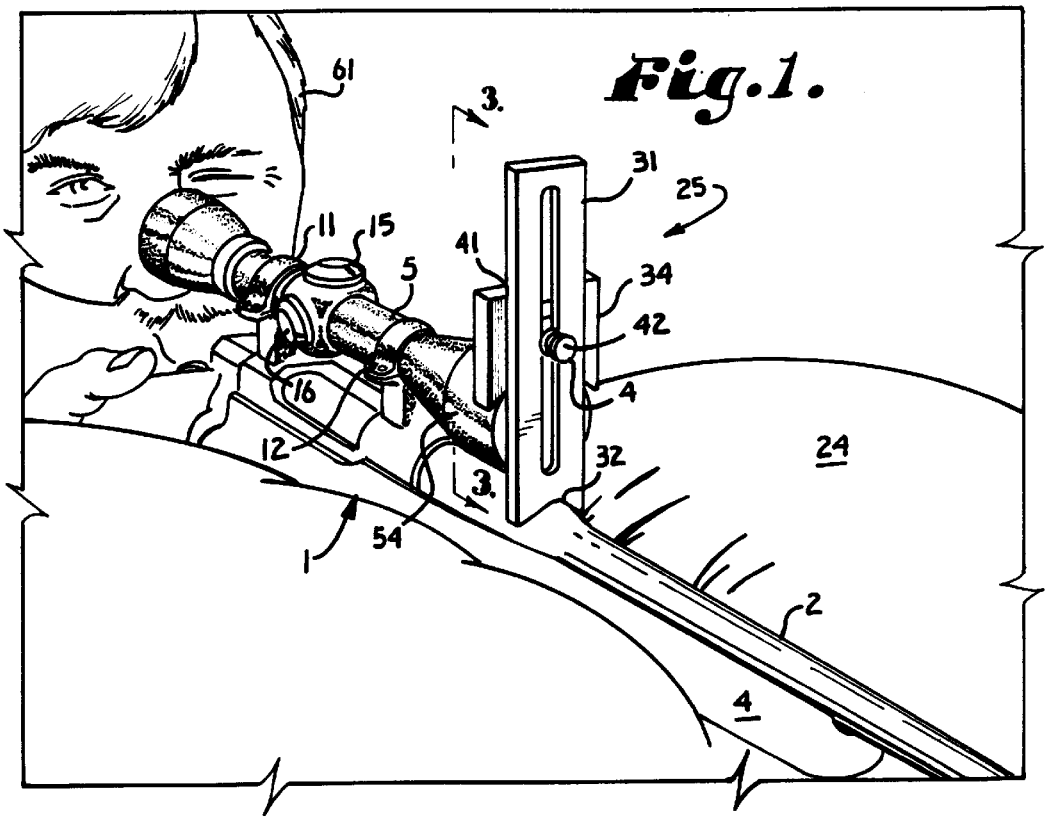
FIG. 1 is a perspective view of a rifle and scope rested on a pillow with an alignment apparatus in accordance with the present invention being used to align the scope vertically with the rifle bore.
Figure 2:
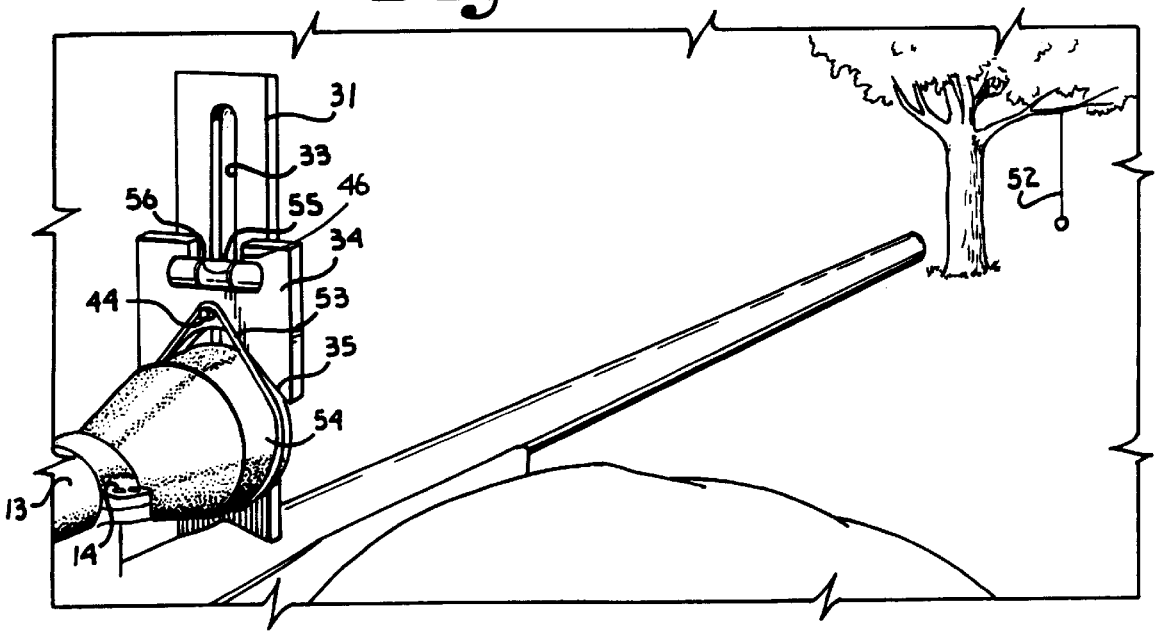
FIG. 2 is a fragmentary, perspective view of the objective end of the scope and the rifle barrel from FIG. 1 showing the rear of the inventive alignment apparatus and a distant vertical reference line (plumb bob).
Figure 3:
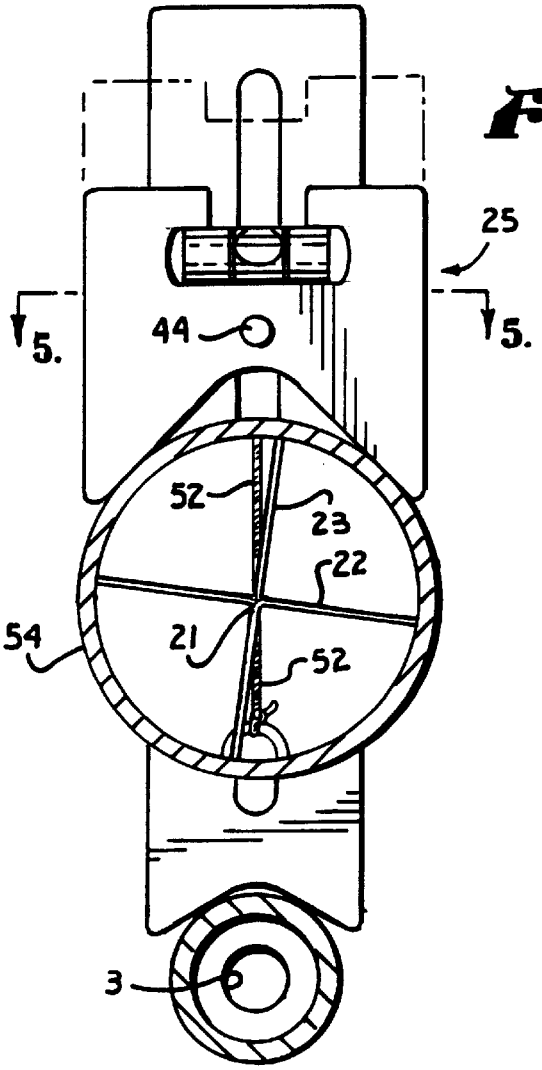
FIG. 3 is a cross sectional view of the rifle bore, rifle scope and alignment apparatus, taken along the line 3—3 of FIG. 1 with one plate member shown in solid lines in contact with the scope barrel and in dotted lines slid upward away from the scope barrel and with the vertical alignment reference line (plumb bob) visible through the scope and misaligned with the scope vertical reticle.

Referring to FIGS. 1–5 of the drawings, a rifle, generally indicated at 1, includes a rifle barrel 2 with an internal bore 3 positioned on a stock 4 in a conventional fashion. A rifle sighting scope 5 is mounted on the rifle barrel 2 via a pair of scope mounting clamping rings 11 and 12. Each clamping ring 11 and 12 is tightened about a barrel 13 of the scope 5 via screws 14 on each side of each of the clamping rings 11 and 12. Conventional windage and elevation adjustment screws 15 and 16, respectfully, are provided on the scope 5 to adjust the intersection or crosshair 21 of horizontal scope reticle 22 with vertical scope reticle 23 so that it is aligned with the bore 3 of the rifle barrel 2. In FIGS. 1 and 2, the rifle stock 4 is shown resting on a pillow 24 to provide a stable position for use of a vertical rifle scope alignment apparatus 25.

The alignment apparatus 25 includes a first, flat plate member 31 with a bottom surface 32 shaped as an inverted V. An elongate slot 33 extends through the center of the first plate member 31 in vertical alignment with the center of the inverted V surface 32. A second plate member 34 also has a bottom surface 35 shaped as an inverted V. The second plate member 34 is somewhat wider and considerably shorter than the first plate member 31 and includes a vertical channel 41 (FIG. 5) sized to just accommodate the width of the first plate member 31 so that the first plate member 31 can slide up and down within the channel 41 while always remaining in alignment with the second plate member 34. The second plate member 34 is slidably attached to the first plate member 31 via a threaded screw 42 extending through the slot 33 in the first plate member 34 and into a threaded bore 43 in the second plate member 34. The threaded screw 42 has a shaft 44 sized to fit through the slot 33 and a head 45 with a diameter larger than the width of the slot 33. The second plate member 34 has a horizontally oriented slot 46 in a top surface thereof which accommodates a bubble level 51.

Figure 4:
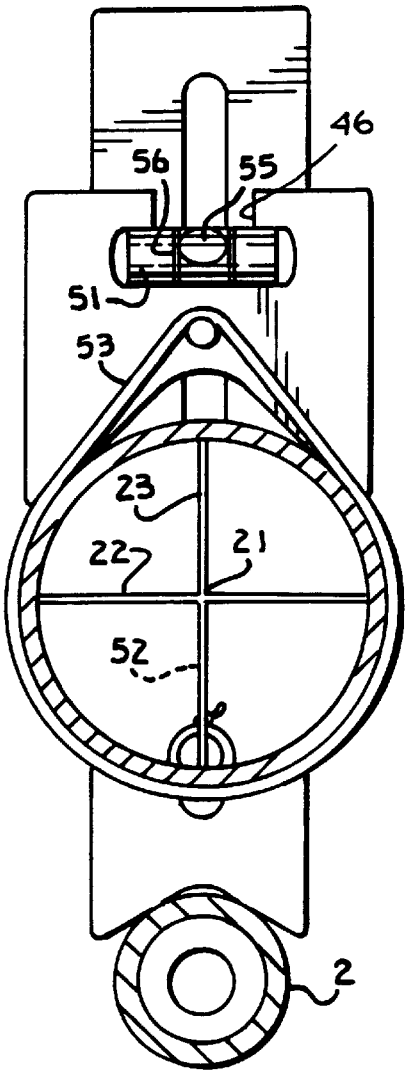
FIG. 4 is a cross sectional view of the rifle bore, rifle scope and alignment apparatus, again taken along the line 3—3 of FIG. 1 with the vertical alignment reference line (plumb bob) visible through the scope and aligned with the scope vertical reticle.
Figure 5:
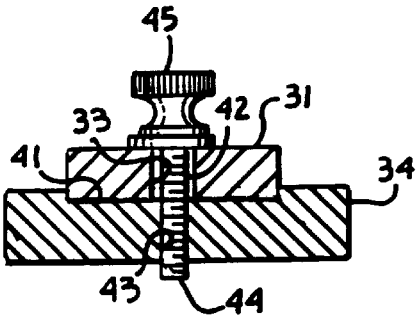
FIG. 5 is a cross-sectional view of the vertical alignment apparatus, taken along line 5—5 of FIG. 3, but without showing the scope or rifle.

In order to use the inventive alignment apparatus 25 to vertically align the vertical scope reticle 23 with the rifle bore 3, the scope 5, a vertical alignment reference line is first located, such as a plumb bob 52. The rifle 1 is then placed on the pillow 24 or other stable rest while being aimed at the plumb bob 52. The scope mounting screws 14 are loosened just enough to allow the scope 5 to be rotated within its clamping rings 11 and 12 with minimal effort. An optional rubber band 53 is placed around an objective end 54 of the scope 5 and the threaded screw shaft 44 on the alignment apparatus 25 is loosened. The inverted bottom V 32 of the first plate member 31 is placed atop the rifle barrel 2 just in front of the objective end 54 of the scope 5. The second plate member 34 is then slidably adjusted upward or downward vertically relative to the first plate member 31 until the bottom inverted V surface 35 can be placed atop the objective end 54 of the scope barrel 13. Each of the inverted V surfaces 32 and 35 must contact the respective rifle barrel 2 and scope barrel objective end 54 in two places for accurate alignment. The threaded screw 42 is then tightened and the rubber band 53 can be placed around the scope barrel 13 and over the end of the screw 42 to retain the apparatus 25 in position. The rifle 1, the scope 5 and the apparatus 25 are then leveled on the pillow 24 by centering a bubble 55 within level marks 56 on the bubble level 51. A user 61 then sights through the scope 5 at the vertical reference line (plumb bob) 52 and rotatably adjusts the scope 5 until the vertical scope reticle 23 is precisely aligned with the external vertical reference line 52, as shown in FIG. 4. The scope mounting screws 14 are then retightened gradually and evenly while rechecking the alignment of the vertical reticle 23 with the reference line 52 until the scope 5 is tightly clamped onto the rifle barrel 2. The alignment apparatus 25 can then be removed from the rifle 1 and scope 5.

The inventive alignment apparatus 25 and method uses a basic geometric principle that any two circles which both contact sides of a V at two points must be aligned. The apparatus 25 uses two inverted V surfaces 32 and 35 which are, in turn, precisely vertically aligned via the channel 41 and the bubble level 51 such that the circle of the scope objective end 54 and the circle of the rifle barrel 2 can be aligned vertically merely by leveling the entire rifle 1 and apparatus 25. Vertical scope reticle alignment is then easily accomplished via an external reference line 52, as described above.

Variations on the preferred embodiment represented in FIGS. 1–5 are possible. For example, the inverted V surfaces 32 and 35 are each used to provide a respective pair of barrel contact points. They have the advantage of being usable with multiple barrel diameters. However, the V surfaces 32 and 35 could be replaced by normal V surfaces positioned beneath the rifle barrel 2 and scope barrel 13 with alignment of the V surfaces being accomplished with a frame which accommodates the rifle barrel 2. Alternatively, any means of providing parallel pairs of aligned barrel contact points could be used in place of the inverted V surfaces 32 and 35 such as an inverted U on the first plate member 31 and a pair of contact pins protruding outward from the surface of the second plate member 34. As a further variation, an apparatus which uses two respective parallel pairs of horizontally spaced round pins or spheres positioned to contact respective ones of the rifle barrel 2 and the scope barrel 13 at dual contact points could be used in place of the inverted V surfaces 32 and 35 of the alignment apparatus 25. For further variations, instead of the channel 41 machined out of the second plate member 34, a channel could be formed by using an angle member as the second plate member 34 with sides spaced to just accommodate the width of the first plate member 31. Alternatively, the first and second plate members 31 and 34 could be hinged to each other via a spring loaded hinge or the like which would maintain the plate members in a parallel relationship. The claims are thus intended to cover these and other variations in the alignment apparatus 25. Other variations will occur to those skilled in the art.

It is thus to be understood that while certain forms of the present invention have been illustrated and described herein, it is not to be limited to the specific forms or arrangement of parts described and shown.

What is claimed and desired to be secured by Letters Patent is as follows:

1. A rifle scope vertical alignment apparatus comprising:

a) a first member with a pair of rifle barrel contact points;

b) a second member with a pair of scope barrel contact points; and c) an alignment mechanism connecting said first member to said second member such that said rifle barrel contact points are positioned parallel to said scope barrel contact points.

2. A rifle scope vertical alignment apparatus as in claim 1, and further comprising:

a) a level positioned on one of said first and second members in a position such that it is visible from a rear surface of said alignment apparatus.

3. A rifle scope vertical alignment apparatus as in claim 2 wherein said level is a bubble level.

4. A rifle scope vertical alignment apparatus as in claim 1, wherein said alignment mechanism comprises:

a) a vertically oriented channel in one of said first or second members which channel is sized to accommodate all or a portion of the other of said first and second members such that said first and second members are slidable vertically relative to each other.

5. A rifle scope vertical alignment apparatus as in claim 4, wherein said alignment mechanism further comprises:

a) an elongate slot formed in one of said first or second members;

b) a threaded screw with a shaft sized to extend through said slot and a head sized larger than a width of said slot; and c) a threaded bore in the other of said first and second members and positioned in alignment with said slot when said first and second members are slidably engaged, said threaded bore receiving said threaded screw to retain said first and second members in a predetermined position relative to each other.

6. A rifle scope vertical alignment apparatus as in claim 1, wherein said first member comprises an inverted V bottom surface which provides said pair of rifle barrel contact points.

7. A rifle scope vertical alignment apparatus as in claim 1, wherein said second member comprises an inverted V bottom surface which provides said pair of scope barrel contact points.

8. A rifle scope vertical alignment apparatus for use with a rifle including a rifle barrel with a sighting scope mounted thereon, the apparatus comprising:

a) a first plate member with a bottom surface shaped as an inverted V;

b) a second plate member with a bottom surface shaped as an inverted V; and c) an alignment mechanism connecting said first member to said second member such that said inverted V surfaces are in vertical alignment with each other.

9. A rifle scope vertical alignment apparatus as in claim 8, said alignment mechanism comprising:

a) a channel in one of said first or second plate members which channel is sized to accommodate all or a portion of the other of said first and second plate members such that said first and second plate members are slidable vertically relative to each other;

b) an elongate slot formed in one of said first or second plate members;

c) a threaded screw with a shaft sized to extend through said slot and a head sized larger than a width of said slot; and d) a threaded bore in the other of said first and second plate members and positioned in alignment with said slot when said first and second plate members are slidably engaged, said threaded bore receiving said threaded screw to retain said first and second members in a predetermined position relative to each other.

10. A rifle scope vertical alignment apparatus as in claim 8, and further comprising:

a) a bubble level positioned on one of said first and second plate members in a position such that it is visible from a rear surface of said alignment apparatus.

11. A method of vertically aligning a rifle scope vertical reticle in a rifle scope with a bore of a rifle barrel on which the scope is mounted, the method comprising:

a) positioning a first member with a pair of spaced rifle barrel contact points in contact with the rifle barrel;

b) positioning a second member with a pair of spaced scope barrel contact points in contact with a barrel of the rifle scope;

c) aligning said first member with said second member such that said rifle barrel contact points are positioned parallel to said scope barrel contact points;

d) sighting through said scope at an external vertical reference line; and e) rotatably adjusting said scope until said external vertical reference line and the scope vertical reticle are aligned.

12. A method as in claim 11, wherein said aligning step includes:

a) positioning at least a portion of one of said first or second members in a channel in the other of said first and second members such that said first and second members are slidable vertically relative to each other while maintaining said rifle barrel and scope barrel contact points in parallel.

13. A method as in claim 12, wherein said aligning step further includes:

a) forming an elongate slot in one of said first or second members;

b) inserting a threaded screw with shaft sized to extend through said slot and a head sized larger than a width of said slot through said slot and into a threaded bore in the other of said first and second members; and c) tightening said threaded screw when said rifle barrel contact points are in contact with the rifle barrel and said scope barrel contact points are in contact with the scope barrel.

14. A method as in claim 13, wherein said aligning step further includes:

a) placing an elastic band around the scope barrel and around the shaft of said threaded screw to retain said rifle barrel contact points in contact with the rifle barrel and said scope barrel contact points in contact with the scope barrel.

15. A method as in claim 11, and further comprising:

a) leveling said rifle, scope and first and second members prior to said sighting step.

16. A method as in claim 11, wherein the first positioning step includes placing an inverted V bottom surface of said first member in contact with said rifle barrel such that said inverted V bottom surface contacts said rifle barrel at two spaced points which form said rifle barrel contact points.

17. A method as in claim 11, wherein the second positioning step includes placing an inverted V bottom surface of said second member in contact with said scope barrel such that said inverted V bottom surface contacts said rifle barrel at two spaced points which form said scope barrel contact points.

* * * * *